United States Patent [19]

Lang

[11] Patent Number: 4,944,238

[45] Date of Patent: Jul. 31, 1990

[54] SEMI-SUBMERGED SHIP

[76] Inventor: Thomas G. Lang, 417 Loma Larga Dr., Solana Beach, Calif. 92075

[21] Appl. No.: 447,206

[22] Filed: Dec. 6, 1989

Related U.S. Application Data

[63] Continuation of Ser. No. 233,261, Aug. 17, 1988, abandoned.

[51] Int. Cl.[5] ..... B63B 1/12; B63B 1/14

[52] U.S. Cl. ..... 114/61

[58] Field of Search ..... 114/61, 256, 265

[56] References Cited

U.S. PATENT DOCUMENTS

| | | | |
|---|---|---|---|
| 3,623,444 | 11/1971 | Lang | 114/61 |
| 3,830,178 | 8/1974 | Lang | 114/61 |
| 3,842,772 | 10/1974 | Lang | 114/61 |
| 3,866,557 | 2/1975 | Lang | 114/61 |
| 3,896,755 | 7/1975 | Marbury | 114/126 |
| 3,897,744 | 8/1975 | Lang | 114/61 |
| 3,960,100 | 6/1976 | Chapman | 114/61 |
| 4,174,671 | 11/1979 | Seidl | 114/61 |
| 4,440,103 | 4/1984 | Lang | 114/61 |
| 4,552,083 | 11/1985 | Schmidt | 114/61 |

FOREIGN PATENT DOCUMENTS

| | | | |
|---|---|---|---|
| 55565 | 4/1967 | Fed. Rep. of Germany . | |
| 167582 | 12/1981 | Japan | 114/61 |
| 1260831 | 1/1972 | United Kingdom . | |
| 1468764 | 3/1977 | United Kingdom | 114/61 |

OTHER PUBLICATIONS

Swath Ocean Ship Builders Catalog, 1988.

AIAA Paper, Sep., 1986.

Extract from AIAA Paper, No. 74–326, "Structural Weight Determination for Swath Ships", Feb., 1974.

Extract from article, "Developments in Swath Technology" by Gupta and Schmidt, Naval Engineers Journal, May, 1986.

Article "The Use of Semi-Submerged Ships to Support New Technology at Sea", The Institute of Electrical and Electronic Engineers, Inc., 9/79.

*Primary Examiner*—Sherman D. Basinger

*Attorney, Agent, or Firm*—Brown, Martin, Haller & McClain

[57] ABSTRACT

A semi-submerged ship which has twin, parallel submerged lower hulls spaced apart at least two hull widths, a strut structure extending upwardly from the hulls on each side of the ship, and a cross-structure connected between the upper regions of the strut structure to connect the opposite sides of the ship together. The strut structure on each side consists of at least two spaced lower struts extending upwardly from the hull on that side, and a single, full length upper strut attached to the upper ends of the lower struts, the upper struts lying above the design water line at rest.

33 Claims, 2 Drawing Sheets

SEMI-SUBMERGED SHIP

This is a continuation of application Ser. No. 07/233,261, filed Aug. 17, 1988 and now abandoned.

BACKGROUND OF THE INVENTION

The present invention relates generally to ships having a pair of submerged hulls supporting a platform above the water surface. These vessels are generally known as semi-submerged ships.

Most conventional surface vessels are subject to large pitching, heaving and rolling motions in heavy seas, both at rest and underway. Such large motions result in seasickness and discomfort, limit vessel speed, limit shipboard operations and vessel uses due to lack of stability on board, and produce large forces on the vessel structures.

In attempting to reduce wave motions, various ships have been designed in which the bulk of the vessel is lifted out of the water, for example, hydrofoil and air cushion supported vessels. Another type of vessel utilizes two submerged buoyant hulls to support a superstructure above the water line. One semi-submerged ship of this general type is described in my U.S. Pat. No. 3,623,444, in which two or more surface piercing struts support a platform above the water from two fin-stabilized submerged hulls. This construction greatly reduces motion in waves.

Other semi-submerged ship constructions are described in my U.S. Pat. Nos. 3,897,744; 3,866,557; and 3,842,772. U.S. Pat. No. 3,842,772 describes a bow impact alleviator to alleviate wave impacts on the cross-structure. This generally comprises projections on the underside of the cross-structure or platform, which are located at or near the bow of the vessel. In U.S. Pat. No. 3,866,557, the vessel comprises twin upper hulls and twin lower, submerged hulls attached together by means of four surface-piercing struts, with a cross-structure connecting the upper hulls. The surface-piercing struts are streamlined from front to rear. This construction is particularly suitable for small sailing boats. My U.S. Pat. No. 4,440,103 describes a semi-submerged ship having a superstructure supported on struts above a pair of submerged buoyant hulls, with cargo space in the struts and submerged hulls. Various shapes of connecting struts are described, including straight and tapered struts and struts having a tapered upper portion and a straight lower portion.

U.S. Pat. No. 4,174,671 of Seidl describes a semi-submerged ship in which the platform is joined to a pair of submerged hulls via struts which are tapered. British Pat. No. 1,260,831 of Shillito describes a vessel with a pair of composite hulls consisting of a floating upper part and a submerged lower part connected together by one continuous strut or two or more separate struts. The floating upper parts are connected by a cross-structure, and are of V-shape.

All of these various designs reduce wave motions over conventional surface boats. However, when travelling at speed in very heavy seas, some bow impacts can still occur, potentially causing damage to the structure. Generally, any means for reducing such impacts will create a much heavier structure with resultant payload penalties.

SUMMARY OF THE INVENTION

It is an object of this invention to provide an improved semi-submerged ship construction which reduces bow impacts and reduces motion in heavy seas.

According to the present invention, a semi-submerged ship is provided which comprises a pair of parallel submerged hulls which are spaced apart by at least two hull widths, at least two separate lower struts extending upwardly from each of the submerged hulls, an upper strut on each side of the ship attached to the upper ends of the lower struts on that side of the ship and extending substantially the full length of the ship, the upper struts being located above the design water line, and a cross-structure extending between the upper struts and lying above the lowermost portions of the upper struts, the lower struts being of different shape to the upper struts.

With this arrangement, the upper struts contact large waves before the cross-structure. The upper struts may be designed at the bow to alleviate water impact forces and to minimize spray on contact with waves, for example by means of cusp-shaped sections. If the design speed of the vessel is moderate to high, fins for dynamic stabilization and control may be attached to the lower hulls. The lower struts are designed large enough to provide an adequate righting moment for static stability.

The upper and lower struts may both be of rectangular transverse vertical cross-section, with the upper struts being wider than the lower struts, or the upper strut may be V-shaped while the lower strut is straight or tapered, for example. The upper struts ar of different transverse vertical cross-sectional dimensions to the lower struts and are preferably wider, so that they displace a greater volume of water if submerged, increasing static stability if the vessel heels.

Preferably, the vessel has a total of four lower struts, comprising a fore and aft lower strut extending upwardly from each submerged hull. The provision of fore and aft lower struts on each side, together with the positioning of the upper struts above the design water line, significantly reduces side loads and motion in beam seas, especially when at rest or travelling at low speeds, since waves can pass through the gap between the fore and aft struts if below the height of the upper struts.

Additionally, the provision of upper struts will help to reduce any "heeling" or "rolling" tendency by increasing the righting moment as the upper strut on one side enters the water, since the upper struts are of larger dimensions than the lower struts.

In some vessel designs, it may be advantageous for the upper struts to be partially submerged when the load exceeds a predetermined value in order to compensate for potential large off-center loads. The partial submersion of the upper struts will increase static stability in a roll by increasing the water displacement. The partial submersion will increase the water contact area, thus increasing vessel drag, but has the advantage of permitting heavier loads than normal to be carried on occasion, for example extra fuel to permit a longer than normal vessel transit range. Drag may be reduced when the vessel is underway by using fins to raise the vessel.

In other designs, it may be preferable to control the water line location independent of the vessel's loading conditions. This may be done by means of ballast tanks located in the lower hulls or struts. Water may be moved into or out of the tanks in order to control vessel draft or trim in response to payload weight and location changes.

The hull cross-section may be enlarged or bulged out in the region between the fore and aft struts. This reduces wave-making drag, and also provides a convenient location for engines in the lower hulls. The hulls may also be provided with bulbous bows for the same reasons.

Preferably, fore and aft cross-braces are provided in the cross-structure and continue down through the upper and lower struts on each side of the vessel to provide an integrated structure with the strength needed to form a stand-alone structural and hydrodynamic framework. Each cross-brace may be in the form of a multiple-section box beam or a set of I-beams structurally connected at their opposite ends to vertical braces extending through the upper and lower strut structure. A wide variety of different superstructures may be attached to such a framework.

BRIEF DESCRIPTION OF THE DRAWINGS

The present invention will be better understood from the following detailed description of some preferred embodiments, taken in conjunction with the accompanying drawings in which like reference numerals refer to like parts, and in which.

DESCRIPTION OF THE PREFERRED EMBODIMENTS

Figure 1:
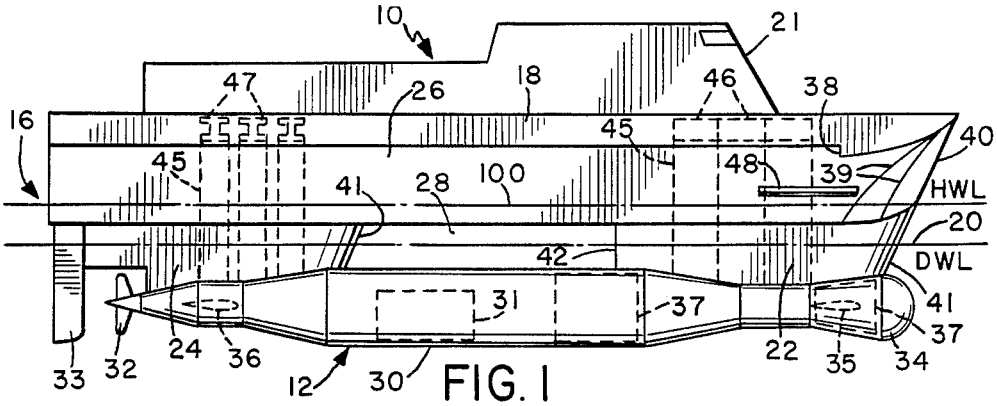
FIG. 1 is a side elevation view of a vessel constructed according to a first embodiment of the present invention.
Figure 2:
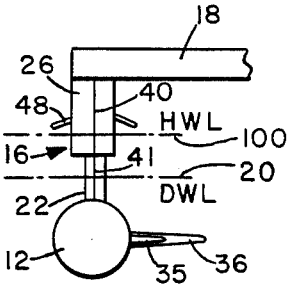
FIG. 2 is a partial front end view of the vessel of FIG. 1.

FIGS. 1 and 2 of the drawings illustrate a semi-submerged ship 10 according to a first embodiment of the present invention. The ship basically comprises a pair of lower, submerged hulls 12 and 14 spaced apart by at least two hull widths, with a strut structure 16 extending upwardly from each of the hulls and a cross-structure 18 connecting the upper ends of the strut structures together above the design water line 20. Any suitable superstructure 21 may be mounted on cross-structure 18 or the upper end of the strut structure according to the type of vessel.

Each strut structure 16 consists of separate fore and aft lower struts 22 and 24 and a single upper strut 26 extending substantially the full length of the vessel. The upper struts lie above the design water line 20, leaving a gap 28 above the water line between the fore and aft struts. The gap between the fore and aft struts on each side significantly reduces side loads and motions in beam seas, particularly when at rest or travelling at low speed. This is because waves can pass beneath the upper struts in the gap with only relatively high waves impacting the upper struts.

Each submerged hull is streamlined, is generally cylindrical, but has varying cross-sectional areas, as indicated in FIG. 1, with a bulged central portion 30 between the fore and aft struts designed to reduce wave making drag by producing waves which interfere with waves produced by the fore and aft struts so as to reduce or cancel the wave pattern. The central bulged area also provides additional space in the hulls for location of engines 31. This location eliminates the need for complex and heavy zee drives or other types of power transmission needed if the engines were located in the upper struts, cross-structure or superstructure. Propellers 32 are located at the rear ends of the hulls and rudders 33 may be located on or near the rear end of the rear lower struts in the slipstream of propellers 32 for improved maneuverability. The hulls may also be provided with a nose bulge 34 to reduce wave-making drag.

As shown in FIGS. 1 and 2, hulls 12 and 14 have forward inboard canard fins 35 and aft inboard stabilizing fins 36, which may optionally be located on the outboard sides. These fins may be of different length than as shown in FIG. 2, if desired. The fins may be canted upward or downward from the horizontal.

Ballast tanks 37 are optionally located in the lower hulls, as illustrated, for controlling the vessel's trim and draft by moving water into and out of the tanks. Ballast tanks may also be located in the struts.

Figure 7:
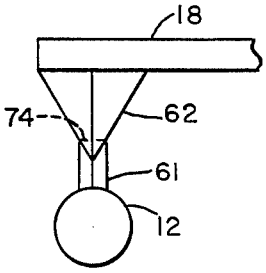

The cross-structure 18 lies above the lowermost portions of the upper struts, so that large waves will contact the upper struts before the cross-structure. The cross-structure 18 may have a transverse upward step 38 adjacent the bow, as illustrated in FIG. 7, in order to detach the water flow during bow impacts. This reduces drag and increases bow lifting force during cross-structure impacts, if any. The bows of the upper struts may have cusp-shaped sections 39 which are designed to reduce water impact forces and to minimize spray upon contact with waves.

Figure 15:
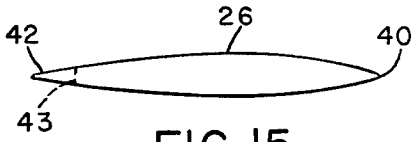
FIGS. 15 and 16 are horizontal cross-sectional views showing alternative upper and lower strut trailing edge shapes.
Figure 16:
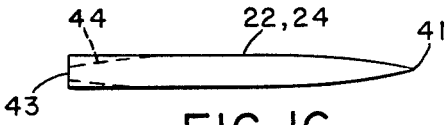

The upper strut is of generally different form to the lower struts. FIGS. 2 to 12 illustrate various alternative upper and lower strut configurations, as described in more detail below. Generally the fore and aft lower struts will have basically the same configuration. Because the upper strut on each side extends the full length of the vessel and the upper strut is of larger dimensions than the lower struts, the righting moment of the vessel will increase significantly as one of the upper struts is submerged, if the vessel tilts to one side. The specific upper and lower strut configuration will be selected according to design considerations. In all cases, the upper strut and front and rear lower struts have streamlined forward edges 40 and 41. The trailing edges of the front, rear and upper struts may be streamlined, boat tailed, or cut off, as generally indicated at 42, 43 and 44 respectively in FIGS. 15 and 16. The boat tailing or cutting off of the struts may be used to reduce frictional drag, to increase buoyancy when immersed, or to simplify construction.

The upper and lower struts may be constructed as an integrated structure, with the lower strut structure carried through the upper strut and into the cross-structure to join the two sides of the vessel together. This is illustrated generally in FIG. 1, where braces or beams 45 extend through the lower and upper strut structures and are connected at their upper ends to the opposite ends of cross-braces extending across the cross-structure, which may be in the form of box beams 46 as shown at the fore end of the ship in FIG. 1, or a set of I-beams 47 with their lower surfaces enclosed, as shown at the aft end of the vessel. The resulting fore and aft cross-braces provide the strength needed to form a stand alone structural and hydrodynamic framework on which a box-like cabin or superstructure 21 can be mounted.

As mentioned above, the upper strut is of different shape to the lower struts so as to produce a varying, generally increasing righting moment when the vessel heels. The lower struts are designed to be large enough in water plane area to provide adequate static stability in roll and pitch, while keeping the water plane area as small as possible, while the upper struts are of larger dimensions so as to increase static stability on heeling.

The static stability of a twin hulled vessel will depend on its righting moment when heeled, which will generally depend on the transverse metacentric height of the vessel, the metacenter being above the center of gravity. The transverse metacentric height (GMT) is given by:

$$GMT = B^2 * A/(4*V) - BG$$

according to Naval Architecture Theory, where

B is the transverse spacing of the strut center lines,

A is the total cross-sectional area of the struts at the water line,

V is the displaced volume of the vessel, and

BG is the distance from the center of buoyancy upward to the center of gravity.

GMT must be greater than zero for static stability in roll, and should preferably be equal to several feet to accommodate off-center loads and crosswinds without excessive heel. Thus, the lower struts are designed according to the overall vessel parameter so as to meet this requirement. Increased water plane area increases displacement, and thus improves static stability. However, this also results in increased drag. In order to reduce drag, the lower strut water plane areas are made as small as possible while meeting static stability requirements for the vessel when upright. When the vessel heels, the larger, upper strut on one side enters the water and significantly increases the righting moment, thereby counteracting large off-center loads or movements or shifts in load.

Although the vessel is designed so that the upper struts are above the design water line, it may be desirable in some applications for the upper struts to be partially submerged under heavy loads, as illustrated by the heavy load water line 100 in FIGS. 1 and 2. This design would be used in vessels where heavy loads exceeding normal design loads are sometimes carried, for example, when extra fuel is carried to permit extra-long vessel transit range. The partial submergence of the upper strut allows more displacement, and thus improved stability. If large off-center loads occur, the vessel will heel and partial submersion of the upper strut on the low side will serve to reduce the otherwise much larger heel, which would have occurred if the upper strut had been located much higher above the water line.

The partial submersion of the upper strut under heavy loads will increase drag, but this disadvantage will be outweighed by the advantage of being able to carry heavy loads on occasion. Drag may be reduced when underway by using fins to raise the vessel, reducing the wetted surface area.

In other vessel designs, it may be more desirable to control the waterline location independent of the vessel load. For example, the upper struts could always be kept above the waterline when the vessel is upright and at rest by appropriate control of water into or out of ballast tanks in the hulls and/or lower or upper struts. Alternatively, the vessel's draft or trim can be changed by adding or removing water from the tanks.

FIGS. 2 to 12 illustrate various alternative configurations for the upper and lower struts, which may be selected according to the type of vessel, vessel speed, weight and so on. This shape will generally extend the length of the vessel, apart from the streamlining at the forward ends of the struts and the optional boat-tailing or streamlining at the rear ends of the struts. However, the midship cross-sectional shape of that portion of each upper strut extending between the lower struts and below the cross-structure may be rectangular, circular, elliptical, or V-shaped, according to design considerations and the desired water clearance.

In the version illustrated in FIG. 2, the upper and lower struts are generally rectangular with the upper strut being wider than the lower strut so that it acts like a spray rail. Additional spray rails 48 may be attached to the upper strut 26, as indicated in FIG. 2, or alternatively to the lower strut so as to reduce spray drag and deflect the spray sidewardly and/or downwardly. The spray rails will have an inclination in the range from horizontal up to a 20 degree downward angle when viewed from the front. FIG. 2 shows spray rails having a slight downward angle. It will be understood that spray rails may also be incorporated in the modified strut structures of FIGS. 3 to 12, if desired. Additionally, for moderate to high design speeds, the lower hulls may be provided with fins for dynamic stabilization and control.

Figure 3:
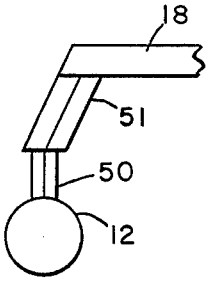
FIG. 3 is a view similar to FIG. 2 illustrating a modified strut structure.
Figure 4:
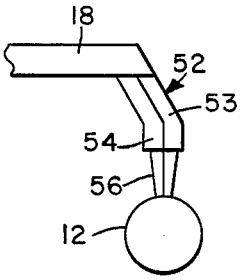
FIGS. 4 to 12 are views similar to FIG. 2 showing further alternative strut configurations.
Figure 5:
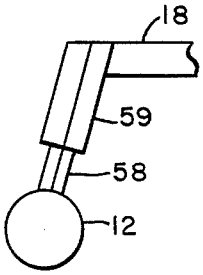

FIG. 3 illustrates a canted arrangement in which the lower struts 50 are vertical while the upper struts 51 are inclined inwardly and upwardly to reduce cross-structure dimensions, with resultant savings in weight and cost. FIG. 4 shows another modified canted structure in which the upper strut 52 has a canted upper portion 53 and a straight lower portion 54, and the lower struts 56 taper inwardly in a downwards direction. The tapering of the lower struts provides more displacement and greater static stability when immersed. FIG. 5 shows another canted design, in which the lower and upper struts 58 and 59 are both canted inwardly. Additionally, the cross-structure is mounted between the inside upper edges of the upper struts in this version, further reducing its dimensions. In all of the versions shown in FIGS. 2 to 5, the upper strut is wider than the lower struts.

Figure 6:
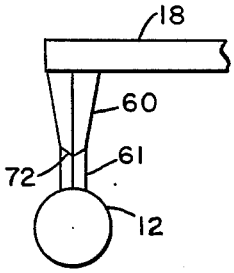
Figure 8:
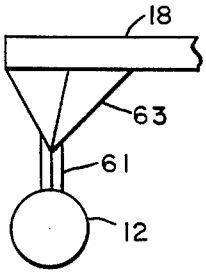
Figure 9:
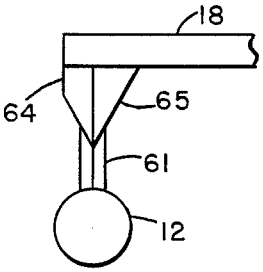
Figure 10:
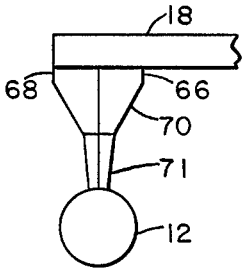

In the modification shown in FIG. 6, upper strut 60 is tapered or V-shaped in a downwards direction for improved static stability in the event that the vessel tilts to immerse one of the upper struts while the lower strut 61 is straight. In FIG. 7, the upper strut 62 is extra thick and more highly tapered to provide even greater static stability. FIG. 8 is similar to FIG. 7, except that the highly tapered upper strut 63 is also canted to reduce cross-structure beam. FIG. 9 is the same as FIG. 7, except that the outboard region 64 of the upper strut 65 is cut off to reduce weight, producing an asymmetrical cross-section. In FIGS. 7 to 9, lower struts 61 are straight as in FIG. 6. In FIG. 10, both inboard and outboard sides 66 and 68 of the upper strut 70 are cut off to provide even more weight reduction. Additionally, lower strut 71 has a slight taper.

The V-shape of the upper strut may be continued down to the lower edge of the strut in the region between the fore and aft lower struts. Alternatively, a shallower angle of the V-shape may be provided at the bottom 72 of upper strut 61, as indicated in FIG. 6, in the region between fore and aft lower struts, to provide slightly more water clearance allowing the upper strut to clear slightly higher waves. Alternatively, the V-shape may simply be cut off flat in the gap between the fore and aft struts to provide even more vertical wave clearance.

One or more cross-plates or braces 74 preferably extend inside and across the strut structure at the point of intersection between the upper and lower struts, as indicated in FIG. 7, to provide structural strengthening at the intersection. This support is preferably provided in all versions.

Figure 11:
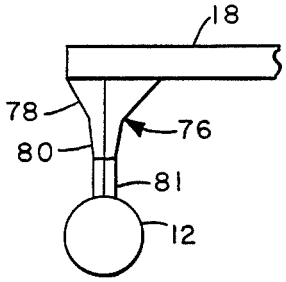

FIG. 11 shows an upper strut 76 having a highly tapered upper portion 78 and a lower portion 80 of reduced taper. Lower strut 81 is straight. This produces a dog leg which is in the reverse direction to that of FIG. 10, providing less change in water displacement as a function of immersion on heeling.

Figure 12:
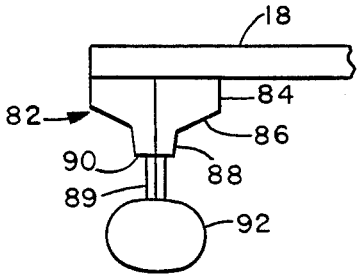

In FIG. 12, the upper strut 82 is much thicker and has a rectangular upper portion 84, a highly tapered central portion 86, and a lower portion 88 of reduced taper. The lower strut 89 is straight and has a step 90 at the point of intersection between the upper and lower struts, as in FIGS. 2 to 5. This arrangement also varies the displacement as a function of strut immersion so that the righting moment will vary as a function of the degree of tilt, and will generally increase with increasing tilt of the vessel. FIG. 12 also illustrates a modified lower hull 92 of generally oval rather than circular cross-section as in the previous embodiments. The lower hull 92 consists of two half cylinders spaced apart by a rectangular section in order to reduce draft and side load in beam waves. Alternatively, the hull 92 may be of elliptical cross-section.

Figure 13:
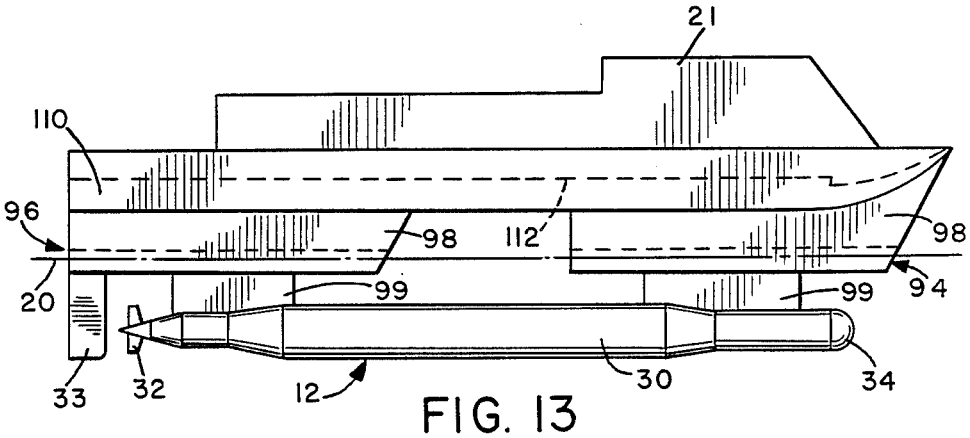
FIG. 13 is a view similar to FIG. 1 showing an alternative embodiment of the invention.

FIG. 13 illustrates another modified strut structure in which the lower struts 94 and 96 are each divided into an upper portion 98 and a lower portion 99, where the upper portion has a greater chord length than the lower portion. The upper portion may begin just above the water surface or may be designed to extend down to or just below the design water line 20, as illustrated in FIG. 13. This arrangement reduces drag by reducing wetted surface area, reduces side forces in beam seas, and still provides an adequate righting moment when heeled. As in the embodiment of FIG. 1, a single upper strut 110 extends the full length of the vessel on each side and secures the upper ends of the upper portions 98 to cross-structure 112. The cross-sectional shape of the upper and lower struts may be as shown in any of the embodiments of FIGS. 2 to 12. Upper portion 98 of each lower strut may be of different transverse cross-sectional shape to the lower portion 99.

The cross-structure 112 extends between the inner faces of upper struts 110, rather than being mounted on top of the upper struts as in FIG. 1. The vessel shown in FIG. 13 is otherwise identical to that of FIG. 7 and like reference numerals have been used where appropriate.

Figure 14:
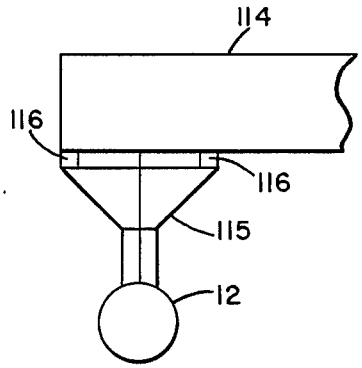
FIG. 14 is a view similar to FIG. 2 showing another modification.

The cross-structure may be mounted on the upper struts in any suitable manner, according to the ship design. In the modification shown in FIG. 14, the cross-structure 114 is resiliently mounted on upper struts 115 by means of suitable resilient shock absorber pads 116 or the like located at the inboard and outboard edges of the upper strut. This tends to isolate the cross-structure and superstructure from engine vibrations, reducing the effect of such vibrations. Alternatively, where vibration is not a problem, the cross-structure may be welded or otherwise rigidly connected to the upper struts. A welded connection will be used where the cross-structure is of the same material as the upper struts with alternative fasteners, such as bolts or special welding strips being used where the structures are of different materials.

The semi-submerged ship construction described above has reduced motion in heavy seas and increased righting moment when heeled, resulting in improved overall stability. Other advantages of the construction include additional internal volume provided by the upper and lower strut design and reduction in hydrodynamic drag by allowing the lower strut water plane areas to be minimized while raising the larger upper struts above the design water line, at least under normal load conditions. The construction also allows improved flexibility in outfitting.

Although some preferred embodiments of the invention have been described above by way of example only, it will be understood by those skilled in the field that modifications may be made to the disclosed embodiments without departing from the scope of the invention, which is defined by the appended claims.

I claim:

1. A semi-submerged ship, comprising:

a pair of parallel submerged hulls whose centers are spaced apart by at least two hull widths;

a strut structure extending upwardly from the hulls on each side of the ship;

a cross-structure connected across the upper regions of the strut structure to connect the opposite sides of the ship together;

the strut structure on each side comprising two lower struts extending upwardly from the hull on that side and a single, full length upper strut attached to the upper ends of the lower struts, each upper strut having a transverse width at its upper end which is no narrower than the width of the remainder of the upper strut, the upper struts lying above the operational design water line at least in the region midway between the lower struts;

the lowermost portion of each upper strut in the region midway between the lower struts being no lower than the lowermost portion of the upper strut lying directly above the forward lower strut; and each hull having an enlarged cross-section which extends into the region between the lower struts.

2. The ship as claimed in claim 1, wherein the lowermost portion of each upper strut lies in a region directly above at least one of said lower struts.

3. The ship as claimed in claim 1, wherein engines are mounted in the enlarged cross-sections of the hulls.

4. The ship as claimed in claim 1, wherein the hulls have bulbous bows.

5. The ship as claimed in claim 1, wherein the upper and lower struts comprise an integral structure, and cross-beams extend across the cross-structure to connect the upper regions of the strut structure together.

6. The ship as claimed in claim 5, wherein at least some of the cross-beams comprise box beams.

7. The ship as claimed in claim 5, wherein the lower strut structure extends through the upper strut and through the cross-structure to form fore and aft cross-beams.

8. The ship as claimed in claim 1, including resilient joint means having greater resiliency than a standard welded or other rigid joint for resiliently mounting the cross structure to the upper struts.

9. The ship as claimed in claim 8, wherein the cross-structure is mounted above the upper ends of the upper struts.

10. The ship as claimed in claim 1, wherein the lower struts are tapered upwardly and outwardly.

11. The ship as claimed in claim 1, wherein the lower struts are of increasing length in an upward direction.

12. The ship as claimed in claim 1, wherein the upper struts are tapered upwardly and outwardly.

13. The ship as claimed in claim 1, wherein the upper struts are canted inwardly in an upwards direction.

14. The ship as claimed in claim 1, wherein the upper and lower struts are canted inwardly in an upwards direction.

15. The ship as claimed in claim 1, wherein the upper struts have upper portions which are canted inwardly in an upwards direction and lower portions which extend vertically.

16. The ship as claimed in claim 1, including internal connecting means at the junction between the upper and lower struts, the connecting means including structural plates extending transversely across the strut structure at the junction between the struts.

17. The ship as claimed in claim 1, wherein the upper struts have a generally V-shaped vertical transverse cross-section.

18. The ship as claimed in claim 17, wherein the lower end of said V-shape comprises a second, intersecting V-shape of shallower angle than the remainder of the V-shape in the region between the fore and aft lower struts.

19. The ship as claimed in claim 17, wherein the lower end of the V-shape is truncated between the fore and aft lower struts.

20. The ship as claimed in claim 1, wherein the upper struts have a generally rectangular vertical transverse cross-section.

21. The ship as claimed in claim 1, wherein the upper struts have an upper portion of rectangular vertical cross-section and a lower portion of V-shaped vertical cross-section.

22. The ship as claimed in claim 21, wherein the lowermost end of the V-shaped lower portion is truncated.

23. The ship as claimed in claim 1, wherein each upper strut has a concave portion in its vertical transverse cross-section.

24. The ship as claimed in claim 1, wherein the maximum transverse thickness of the upper struts is greater than that of the lower struts.

25. The ship as claimed in claim 1, wherein each lower strut comprises an upper portion and a lower portion, the upper portion of each lower strut having a generally greater chord length than the lower portion.

26. The ship as claimed in claim 25, wherein the upper portions of the lower struts extend down close to the design water level.

27. The ship as claimed in claim 25, wherein the upper portions extend down to or below the design water level.

28. The ship as claimed in claim 1, wherein the upper struts are located below the water level under loads above a predetermined value.

29. The ship as claimed in claim 1, including spray rails attached to the strut structure.

30. The ship as claimed in claim 29, wherein the spray rails are inclined downward at a transverse angle of between 0 degrees and 20 degrees to the horizontal.

31. The ship as claimed in claim 1, wherein the cross-structure has a transverse upward step on its undersurface near the bow.

32. The ship as claimed in claim 1, including ballast tanks and means for taking in and removing water from the ballast tanks to control the water line location at rest.

33. The ship as claimed in claim 1, wherein the upper and lower struts are of different shapes.

* * * * *